United States Patent [19]

Maeda et al.

[11] Patent Number: 4,893,105

[45] Date of Patent: Jan. 9, 1990

[54] TRANSFORMER WITH TAPERED CORE

[75] Inventors: Tsutomu Maeda; Kiyoshi Matsui; Takayuki Kanno; Kunihiro Sato, all of Tokyo, Japan

[73] Assignee: TDK Corporation, Tokyo, Japan

[21] Appl. No.: 212,643

[22] Filed: Jun. 28, 1988

[30] Foreign Application Priority Data

Jun. 30, 1987 [JP] Japan ..... 62-100317[U]
Jun. 30, 1987 [JP] Japan ..... 62-100318[U]
Feb. 6, 1988 [JP] Japan ..... 63-14809[U]

[51] Int. Cl.[4] ..... H01F 15/04; H01F 27/30

[52] U.S. Cl. ..... 336/84 M; 123/634; 336/107; 336/185; 336/198; 336/233

[58] Field of Search ..... 123/634, 635; 336/105, 336/107, 192, 82, 96, 212, 233, 84 C, 84 M, 198, 208, 185, 84 R

[56] References Cited

U.S. PATENT DOCUMENTS

| | | | |
|---|---|---|---|
| 1,909,491 | 5/1933 | Howie | 336/107 X |
| 2,321,356 | 6/1943 | Berman | 336/107 X |
| 2,414,692 | 1/1947 | Harkness et al. | 336/107 X |
| 2,461,098 | 2/1949 | Weatherly | 336/107 X |
| 2,571,769 | 10/1951 | Segall | 336/107 X |
| 4,099,510 | 7/1978 | Perrier et al. | 336/96 X |
| 4,177,782 | 12/1979 | Yoshinari et al. . | |
| 4,459,967 | 7/1984 | Hayashi | 123/634 |
| 4,514,712 | 4/1985 | McDougal | 336/96 |
| 4,580,122 | 4/1986 | Wörz | 336/96 |
| 4,617,907 | 10/1986 | Johansson et la. | 123/634 X |

FOREIGN PATENT DOCUMENTS

| | | | |
|---|---|---|---|
| 51-126430 | 11/1976 | Japan . | |
| 52-21613 | 2/1977 | Japan . | |
| 54-96737 | 7/1979 | Japan . | |
| 56-145829 | 4/1981 | Japan . | |
| 59-104521 | 7/1984 | Japan . | |
| 62-89114 | 6/1987 | Japan . | |
| 526687 | 9/1940 | United Kingdom | 336/107 |

*Primary Examiner*—Thomas J. Kozma
*Attorney, Agent, or Firm*—Armstrong, Nikaido, Marmelstein, Kubovcik & Murray

[57] ABSTRACT

In a transformer including a low-voltage input coil, a high-voltage output coil disposed coaxially of the low-voltage input coil, and a core for magnetically connecting both of the coils together; the improvement comprising a first bobbin around which the low-voltage input coil is wound which first bobbin has an inner-diameter hole, wherein the core comprises a rod portion to be inserted into the inner-diameter hole of the first bobbin and a flange portion provided at one axial end of the rod portion. In another aspect of the invention, the transformer further comprises a second bobbin around which the high-voltage output coil is wound, and a connector adapted to be connected to an ignition plug which connector is mounted on an end surface of the second bobbin on the opposite side of the flange portion of the core in such a manner that a mounting direction of the connector substantially coincides with an axial direction of the second bobbin. In a further aspect of the invention, the transformer further comprises a shield case formed of a magnetic conductive material surrounding an outer periphery of the connector or entirely surrounding the transformer. The rod portion of the core may have a tapering cross section such that it is gradually tapered from a low voltage side of the high-voltage output coil to a high voltage side thereof. With this arrangement, the transformer may be easily assembled and made compact. Further, a magnetic efficiency may be improved, and an insulating distance between the low-voltage input coil and the high-voltage output coil may be ensured.

3 Claims, 10 Drawing Sheets

TRANSFORMER WITH TAPERED CORE

BACKGROUND OF THE INVENTION

The present invention relates to a transformer, and more particularly to a transformer adapted to be used as an ignition coil for supplying high voltage to an ignition plug.

As well known in the art, a conventional transformer is generally constructed by assembling two or more coils with a core of types such as EE, EI, UU and UI forming a closed magnetic circuit. Referring to FIG. 8 which is a cross section of the conventional transformer for outputting high voltage, the transformer includes E-cores 11 and 12 formed of a magnetic material such as ferrite, a low-voltage input coil 13, a high-voltage output coil 14, an insulating cover 15 entirely covering both the coils, a bobbin 16 on which the low-voltage input coil 13 is wound, and a bobbin 17 on which the high-voltage output coil 14 is wound. The bobbin 17 is formed with a plurality of flange portions 171 axially spaced a suitable distance to define a plurality of coil winding sections where the high-voltage output coil 14 is continuously wound. The bobbin 16 is coaxially inserted into an inner-diameter hole 172 of the bobbin 17, and the cores 11 and 12 of EE-, EI-, UU- or UI-type are inserted into an inner-diameter hole 161 of the bobbin 16 from axially opposite sides, thus forming a closed magnetic circuit.

While the invention has been particularly shown and described in reference to preferred embodiments thereof, it will be understood by those skilled in the art that changes in form and details may be made therein without departing from the spirit and scope of the invention.

In the conventional transformer as mentioned above, the closed magnetic circuit is formed by the cores 11 and 12 of EE-, EI-, UU- or UI-type, magnetic connection between both the coils 13 and 14 is high. However, there exist the following problems.

(a) As the cores 11 and 12 are disposed outside the insulating cover 15, the general construction is enlarged to cause the difficulty in making the transformer compact, and the external shape is complicated. This type of transformer is used as an ignition coil for supplying high voltage to an ignition plug for an automobile, for example. Therefore, it is important to make the transformer compact and simlify the shape thereof in applying the transformer to the ignition coil.

(b) To make the transformer compact and simplify the shape thereof, there has been used an I-core forming an open magnetic circuit. However, the magnetic connection between the coils is decreased to reduce the efficiency of the transformer, resulting in a reduction in operation speed.

In a plug ignition circuit for an internal combustion engine, there is generated electromagnetic wave noise from an ignition plug device or the like due to spark discharge. Further, there are also generated magnetic noise, electrostatic noise and the like from the transformer in the ignition plug device. Therefore, it is necessary to suppress such noises. In a conventional ignition plug device, the generation of such noises is suppressed normally by interposing a resistor element for limiting a change in current between the ignition plug in the plug ignition circuit and the high-voltage output coil, or by using another type of ignition plug incorporating a resistor.

However, in the case of applying the transformer to the ignition plug device for the internal combustion engine, it is common that there hardly exists a sufficient space for installing the ignition plug device. Therefore, it is necessary to make the ignition plug device compact and simplify the shape thereof.

FIG. 9 shows the transformer shown in FIG. 8 with an ignition plug 118 connected thereto. The transformer is provided with a connector 119 for the connection with the ignition plug 118 in a direction perpendicular to an axial direction of the bobbin 117. Accordingly, the ignition plug 118 projects from the transformer at right angles to the axial direction of the bobbin 117.

As previously mentioned, this type of transformer is used as an ignition coil or the like for supplying high voltage to an ignition plug for an automobile, and it is common that there hardly exists a sufficient space for installing the transformer. Therefore, it is significant to make the transformer compact and simplify the shape thereof. However, as the ignition plug 118 is connected to the connector 119 at right angles to the axis of the bobbins 116 and 117 on which the coils 113 and 114 are wound, the external shape is complicated, and an occupied area of the ignition plug device is enlarged. Further, the ignition plug device cannot be easily installed.

FIGS. 10 to 12 are cross sections of an essential part of some conventional coil devices to be used for the transformer as mentioned above. The coil devices commonly include a core 11, a low-voltage input coil 12, a high-voltage output coil 13, a bobbin 14 on which the low-voltage input coil 12 is wound, and a bobbin 15 on which the high-voltage output coil 13 is wound. The bobbin 15 is formed with a plurality of flange portions 151 axially spaced a suitable distance to define a plurality of coil winding sections 152 where the high-voltage output coil 13 is continuously wound. The high-voltage output coil 13 is wound on the bobbin 15 from one axial end A to the other axial end B in the direction of arrow a. Therefore, the voltage is low at the one axial end A, and it is high at the other aixal end B. The bobbin 14 on which the low-voltage input coil 12 is wound is coaxially inserted into an inner-diameter hole 153 of the bobbin 15 on which the high-voltage output coil 13 is wound. The core 11 is inserted into an inner-diameter hole 41 of the bobbin 14.

In the coil structure as mentioned above, a sufficient insulating distance must be defined between the low-voltage input coil 12 and the high-voltage output coil 13 particularly at the other axial end B on the high voltage side of the high-voltage output coil 13. One of the measures for defining such a sufficient insulating distance is provided by the structure shown in FIG. 10. That is, a uniform insulating distance $d_1$ is defined over the substantially entire axial length of the coil device between the low-voltage input coil 12 and the high-voltage output coil 13. Another measure is provided by the structure shown in FIG. 11. That is, the depth of the coil winding sections 152 of the bobbin 15 gradually decreases from the low voltage side to the high voltage side, so that the inner surface of the inner-diameter hole 153 of the bobbin 15 is negatively tapered, and accordingly the insulating distance gradually increases from the low voltage side to the high voltage side. A further measure is provided by the structure shown in FIG. 12, wherein the depth of the coil winding sections 152 of the bobbin 15 gradually decreases from the low voltage side to the high voltage side in the same manner as the structure of FIG. 11, and the wall thickness of the bobbin 15 gradually increases toward the high voltage side, so that the inner surface of the inner-diameter hole 153 is formed into a straight surface not tapered.

However, the coil devices as mentioned above still includes the following problems. In the coil device shown in FIG. 10, a relatively large insulating distance defined on the high voltage side is provided on the low voltage side where such a large insulating distance is not so required. As a result, the magnetic connection between the low-voltage input coil 12 and the high-voltage output coil 13 is reduced, and the general structure is enlarged. Since this type of coil device is importantly applied to an ignition coil for an internal combustion engine with an installation space limited, such a large construction of the coil device does not meet the requirement for the application to the ignition coil.

Further, in the coil devices shown in FIGS. 11 and 12, the shape of the bobbin 15 is complicated to cause an increase in cost because the bottoms of the coil winding sections 152 must be tapered.

SUMMARY OF THE INVENTION

According to a first aspect of the present invention, there is provided in a transformer including a low-voltage input coil, a high-voltage output coil disposed coaxially of said low-voltage input coil, and a core for magnetically connecting both of said coils together; the improvement comprising a first bobbin around which said low-voltage input coil is wound, said first bobbin having an inner-diameter hole, wherein said core comprises a rod portion to be inserted into said inner-diameter hole of said first bobbin and a flange portion provided at one axial end of said rod portion.

With this arrangement, the rod portion constituting a large part of the core is located in the inner-diameter hole of the first bobbin, thereby making the general construction of the transformer compact. Further, as the rod portion is inserted from its one end opposite the end where the flange portion is provided, into the inner-diameter hole of the first bobbin, the core and the first bobbin may be easily assembled. Moreover, a reduction in magnetic efficiency in an open magnetic circuit can be compensated by the flange portion, thereby improving the magnetic efficiency.

According to a second aspect of the present invention, there is provided in a transformer including a low-voltage input coil, a high-voltage output coil disposed coaxially of said low-voltage input coil, and a core for magnetically connecting both of said coils together; the improvement comprising a first bobbin around which said low-voltage input coil is wound, said first bobbin having an inner-diameter hole, wherein said core comprises a rod portion to be inserted into said inner-diameter hole of said first bobbin and a flange portion provided at one axial end of said rod portion; a second bobbin around which said high-voltage output coil is wound; and a connector adapted to be connected to an ignition plug, said connector being mounted on an end surface of said second bobbin on the opposite side of said flange portion of said core in such a manner that a mounting direction of said connector substantially coincides with an axial direction of said second bobbin.

With this arrangement, the rod portion constituting a large part of the core is located in the inner-diameter hole of the first bobbin, thereby making the general construction of the transformer compact. Further, as the rod portion is inserted from its one end opposite the end where the flange portion is provided, into the inner-diameter hole of the first bobbin, the core and the first bobbin may be easily assembled. Moreover, a reduction in magnetic efficiency in an open magnetic circuit can be compensated by the flange portion, thereby improving the magnetic efficiency. Furthermore, as the connector is mounted on the end surface of the second bobbin on the opposite side of the flange portion of the core in such a manner that the mounting direction of the connector substantially coincides with the axial direction of the second bobbin, thereby making easy the connection operation of the ignition plug. Further, the general construction of the transformer connected to the ignition plug may be made compact and simplified, and accordingly an occupied area of the transformer to be installed into an automobile may be reduced.

According to a third aspect of the present invention, there is provided in a transformer including a low-voltage input coil, a high-voltage output coil disposed coaxially of said low-voltage input coil, and a core for magnetically connecting both of said coils together; the improvement comprising a first bobbin around which said low-voltage input coil is wound, said first bobbin having an inner-diameter hole, wherein said core comprises a rod portion to be inserted into said inner-diameter hole of said first bobbin; a second bobbin around which said high-voltage output coil is wound; a connector adapted to be connected to an ignition plug, said connector being mounted to said second bobbin; and a shield case for surrounding at least an outer periphery of said connector.

With this arrangement, the generation of electromagnetic wave noise from the connecting portion between the connector and the second bobbin may be suppressed.

According to a fourth aspect of the present invention, there is provided in a transformer including a low-voltage input coil, a high-voltage output coil disposed coaxially of said low-voltage input coil, and a core for magnetically connecting both of said coils together; the improvement comprising a first bobbin around which said low-voltage input coil is wound, said first bobbin having an inner-diameter hole, wherein said core comprises a rod portion to be inserted into said inner-diameter hole of said first bobbin; said rod portion being disposed coaxially of said both coils and having a tapering cross section such that it is gradually tapered from a low voltage side of said high-voltage output coil to a high voltage side thereof, and wherein said low-voltage input coil is disposed around an outer periphery of said core.

As mentioned above, the rod portion of the core disposed coaxially of both the coils has a tapering cross section such that it is gradually tapered from the low voltage side of the high-voltage output coil to the high voltage side thereof, and the low-voltage input coil is disposed around the outer periphery of the core. Therefore, an insulating distance between the low-voltage input coil and the high-voltage output coil is increased from the low voltage side to the high voltage side. Furthermore, a coil winding portion of the second bobbin where the high-voltage output coil is wound may be formed straight without a tapering shape. Therefore, magnetic connection is improved as compared with the prior art, and the transformer is made compact. Although the core is tapering, it can be formed from a molding of ferrite or the like, and there is no difficulty in imparting the taper to the core.

DETAILED DESCRIPTION OF THE PREFERRED EMBODIMENTS

Figure 1:
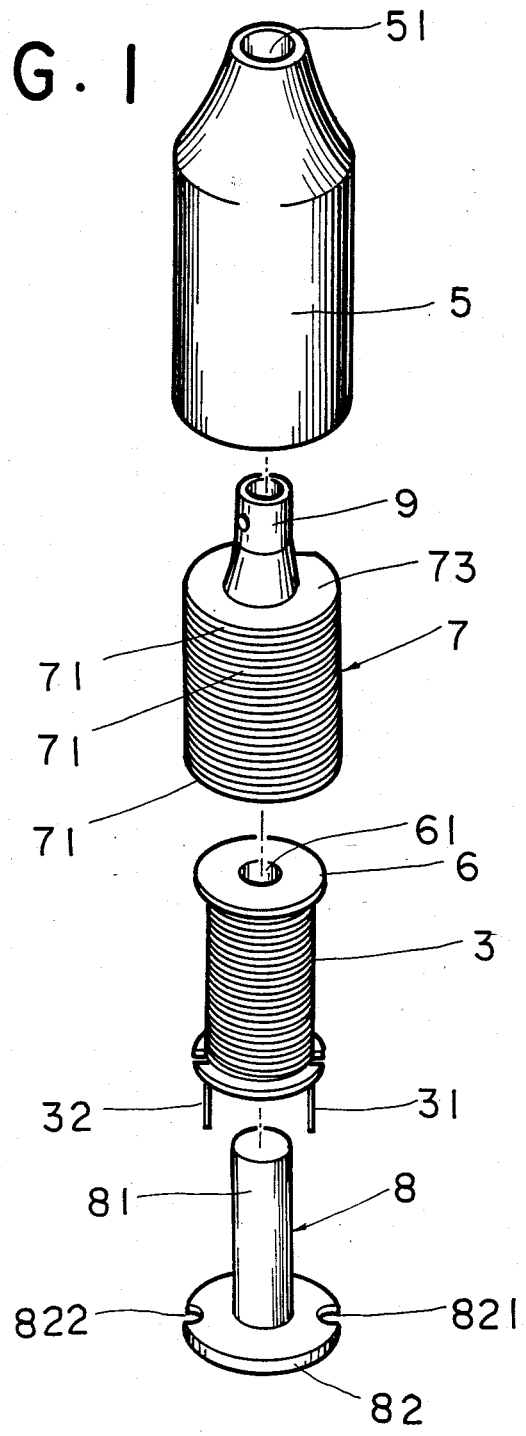
FIG. 1 is an exploded perspective view of the transformer of a first preferred embodiment according to the present invention.
Figure 2:
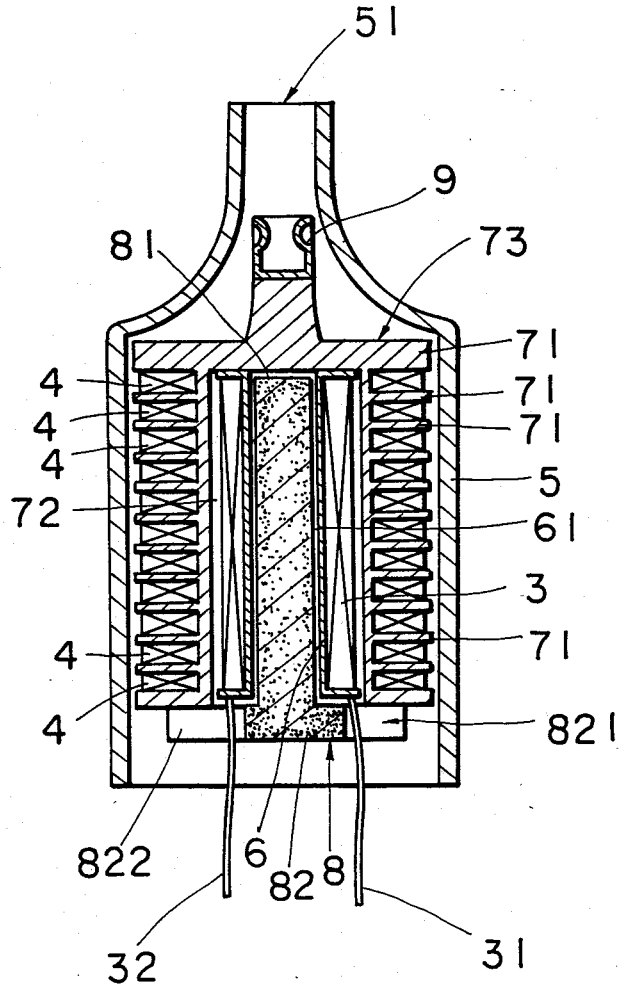
FIG. 2 is a vertical sectional view of the transformer shown in FIG. 1 as assembled.

FIG. 1 is an exploded perspective view of the transformer showing a first preferred embodiment of the present invention, and FIG. 2 is a vertical sectional view of the transformer as assembled. Reference numeral 8 designates a core formed of a ferrite magnetic material or the like. The core 8 is of a sectional T-shape having a rod portion 81 and a flange portion 82 formed at one end of the rod portion 81. The rod portion 81 is inserted into an inner-diameter hole 61 of a bobbin 6 from the lower side thereof. Accordingly, a large part of the core 8 is located in the inner-diameter hole 61 of the bobbin 6, thereby making a general construction compact and simplifying same. Further, as the rod portion 81 of the core 8 is inserted from its upper end opposite the lower end where the flange portion 82 is formed, into the inner-diameter hole 61 of the bobbin 6, the core 8 and the bobbin 6 may be easily assembled.

The flange portion 82 has a diameter substantially the dame as an outer diameter of a bobbin 7, and it is so located as to abut against a lower end surface of the bobbin 7. The flange portion 82 may have any other shapes such as an arcuate shape. Although the magnetic efficiency in an open magnetic circuit formed by an I-core is generally reduced as mentioned above, such a reduction in the magnetic efficiency in the open magnetic circuit by the I-core can be compensated by the flange portion 82 in the present invention, thereby improving the magnetic efficiency.

Reference numerals 31 and 32 designate coil terminals of a coil 3, and reference numerals 821 and 822 designate cutouts for guiding the coil terminals 31 and 32. Although not shown, an insulating resin may be filled inside an insulating cover 5.

In this embodiment, a connector 9 is mounted to an upper end surface 73 of the bobbin 7 opposite the insert side of the core 8 by suitable means such as adhesive or screw in such a manner that a mounting direction of the connector 9 coincides with an axial direction of the bobbin 7. The connector 9 is connected to one end of a high-voltage output coil 4.

The insulating cover 5 is coaxially fitted with the bobbin 7 in such a manner as to surround the outer periphery of the bobbin 7. The insulating cover 5 has an upper opening 51 opposed to the connector 9 for permitting an external connecting member such as an ignition plug to be inserted therethrough and be connected to the connector 9.

Figure 3:
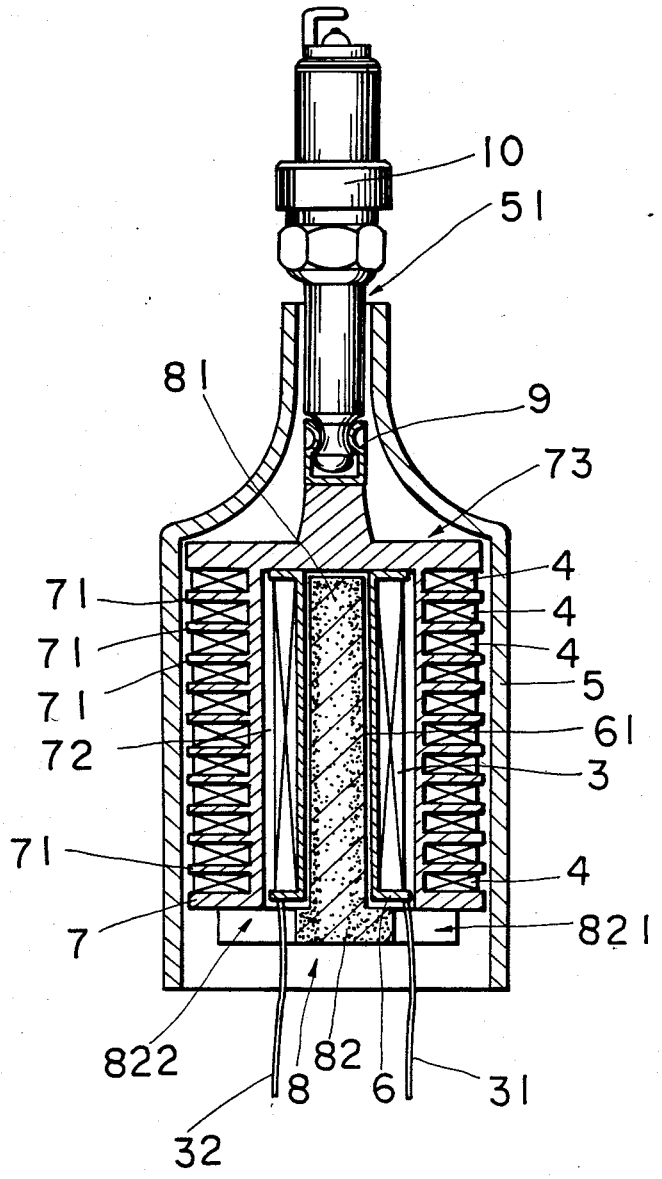
FIG. 3 is a vertical sectional view of the transformer shown in FIG. 2 as connected to an ignition plug.

FIG. 3 shows an applied embodiment wherein the transformer of the present invention is used as an ignition coil for an ignition plug. An ignition plug 10 is directly axially connected to the connector 9.

As mentioned above, in the transformer of the present invention, the core is formed with the rod portion inserted into the inner-diameter hole of the bobbin on which the coil is wound and with the flange portion formed at one end of the rod portion. With this structure, the following advantages may be obtained.

(a) The rod portion constituting a large part of the core is disposed in the inner-diameter hole of the bobbin, thereby making the general construction compact and simplifying same.

(b) The rod portion is inserted from its one end opposite the flange portion into the inner-diameter hole of the bobbin, thereby making the assembling easy.

(c) As the flange portion is formed at one end of the rod portion, the flange portion acts to compensate a reduction in magnetic efficiency in an open magnetic circuit, thus improving the magnetic efficiency.

Figure 4:
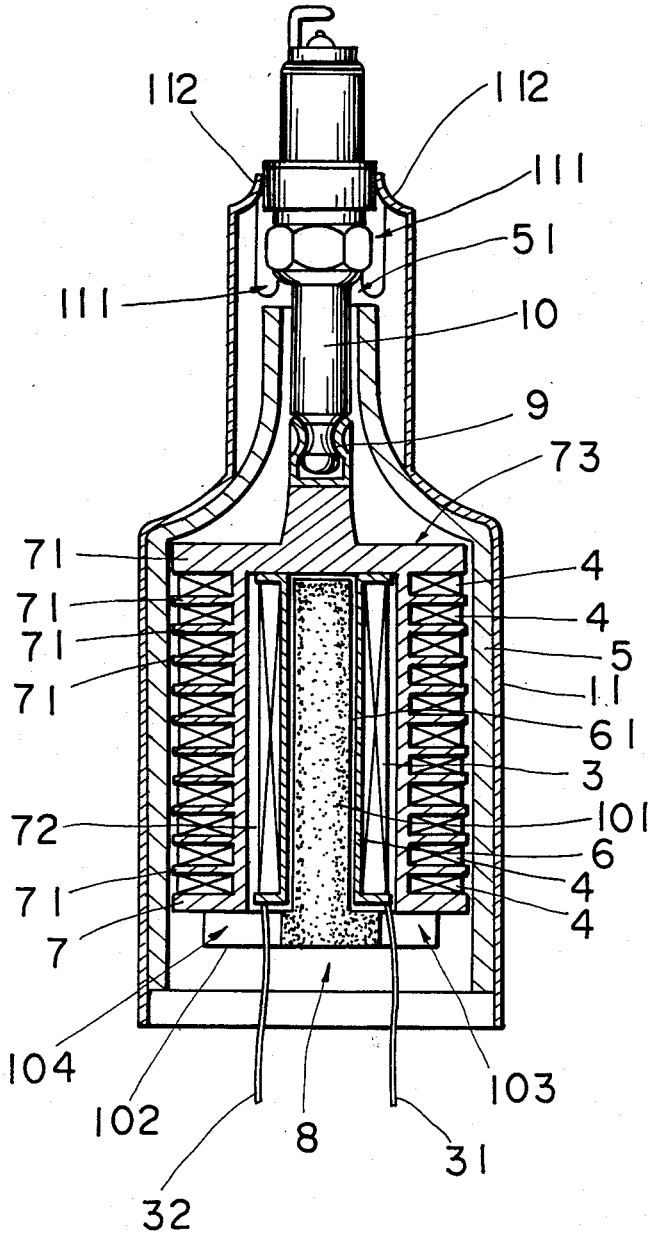
FIG. 4 is a vertical sectional view of the transformer of a second preferred embodiment according to the present invention as connected to an ignition plug.

FIG. 4 shows a second preferred embodiment of the present invention wherein a shield case 11 is provided to cover the outer periphery of the transformer of the first preferred embodiment.

The shield case 11 serves to prevent electromagnetic wave noise to be generated from a connecting portion between the ignition plug and the connector. The shield case 11 is formed of a magnetic conductive material such as iron and nickel or a non-magnetic conductive material such as copper. The shield case 11 is of a cylindrical shape having upper and lower end openings in such a manner as to surround at least a portion of the connector and be fitted with the insulating cover 5. The shield case 11 is formed at its upper end portion with a plurality of slits 111 to form a plurality of spring elements 112.

In this embodiment, as the connecting portion between the connector 9 and the ignition plug 10 is surrounded by the shield case 11, the generation of electromagnetic wave noise from the connecting portion may be prevented. As shown in FIG. 4, the transformer is entirely surrounded by the shield case 11 to also prevent the generation of noise from the transformer. Further, as the spring elements 112 of the shield case 11 abuttingly support the outer peripheral surface of the ignition plug 10, the ignition plug 10 is stably supported to the transformer, and the transformer is reliably prevented from falling. Further, in the case that the transformer is entirely surrounded by the shield case formed of a magnetic conductive material, there is generated a magnetic circuit between the shield case 11 and the core 8 to thereby improve the magnetic efficiency.

Figure 5:
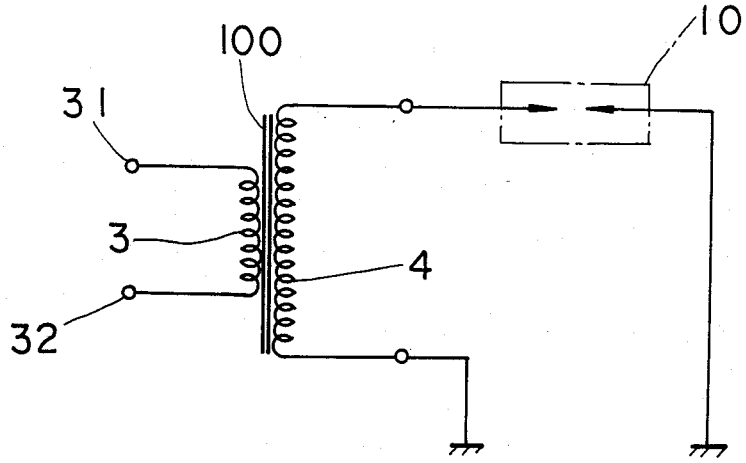
FIG. 5 is an electrical circuit diagram of the device shown in FIGS. 3 and 4.

FIG. 5 is an electrical circuit diagram of an ignition circuit in this embodiment. In a conventional ignition circuit, it is common to provide a resistor for limiting a change in current between the ignition plug 10 and one end of the high-voltage output coil 4, or to use an ignition plug incorporating a resistor, so as to suppress the generation of noise. To the contrary, according to the present invention, the shield case 11 surrounding the connecting portion between the ignition plug 10 and the connector of the transformer is provided to prevent the generation of noise. Thus, as shown in FIG. 5, the ignition plug 10 is connected at one end to the one end of the high-voltage output coil 4, and is connected at the other end to the ground.

Figure 6:
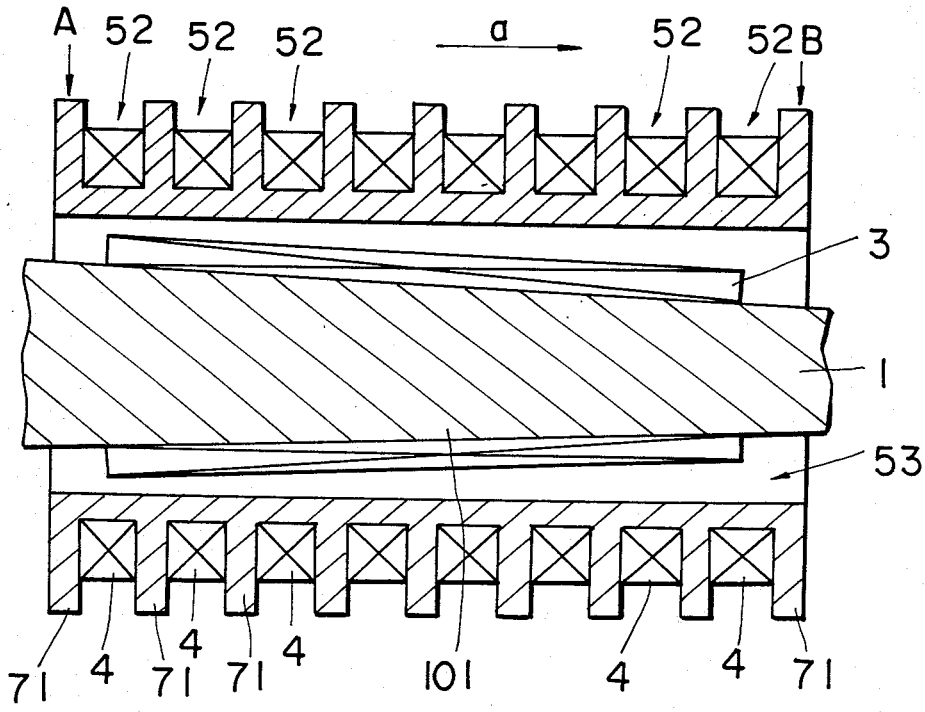
FIG. 6 is a sectional view of the essential part of the transformer of a third preferred embodiment according to the present invention.
Figure 7:
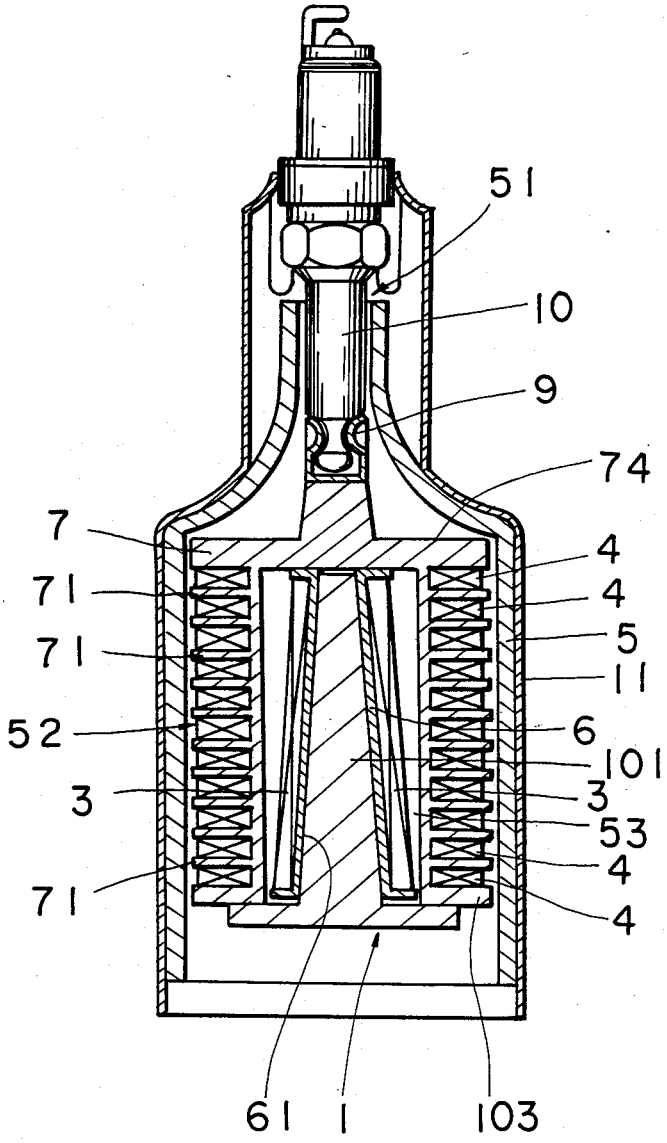
FIG. 7 is a vertical sectional view of the transformer of the third preferred embodiment as connected to an ignition plug.
Figure 8:
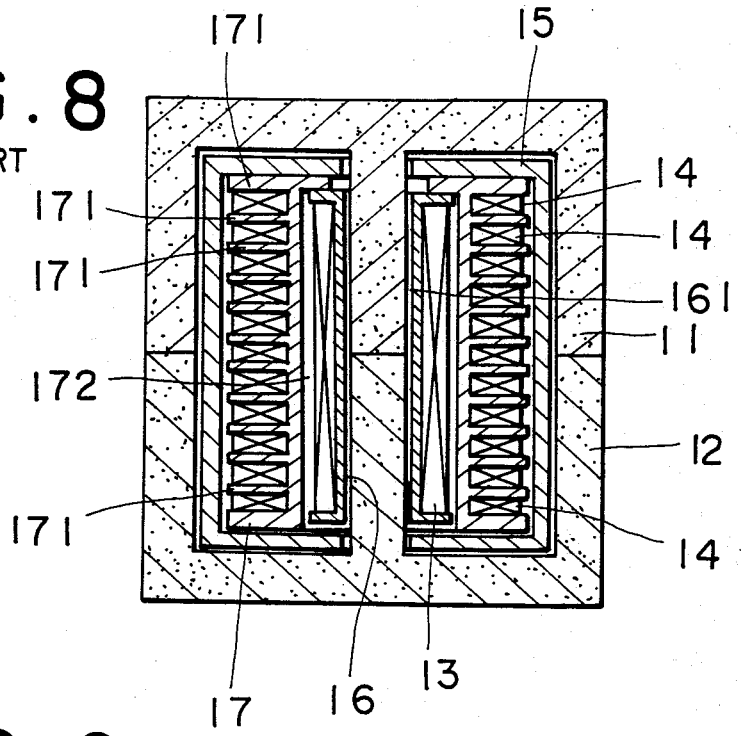
FIG. 8 PRIOR ART
FIG. 8 is a cross section of the conventional transformer.
Figure 9:
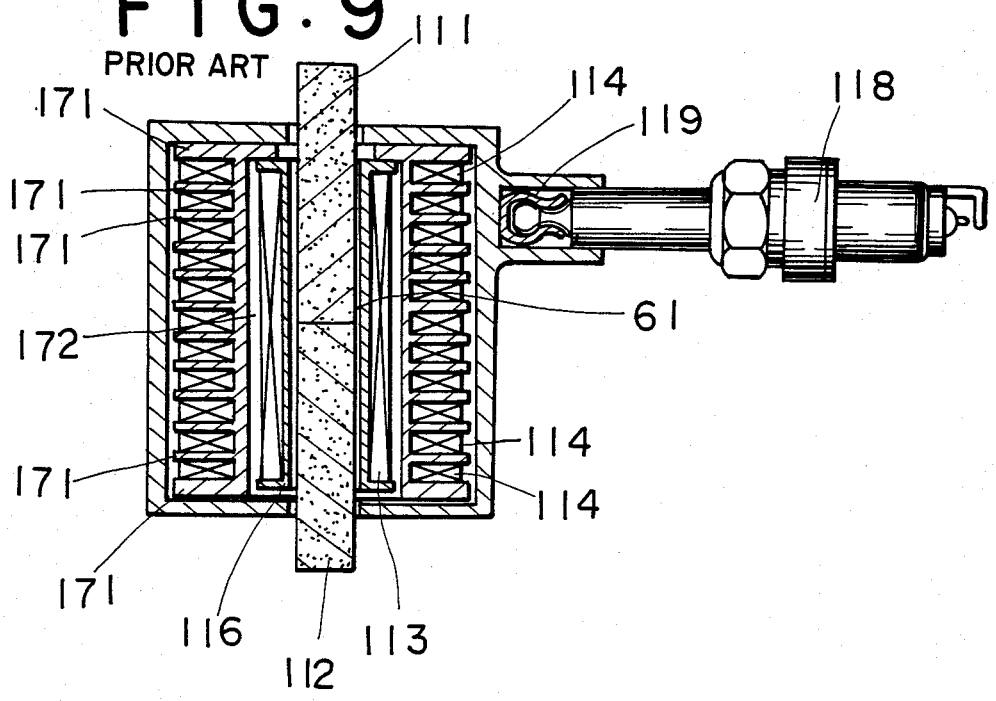
FIG. 9 PRIOR ART
FIG. 9 is a vertical sectional view of the transformer shown in FIG. 8 as applied to an ignition plug.
Figure 10:
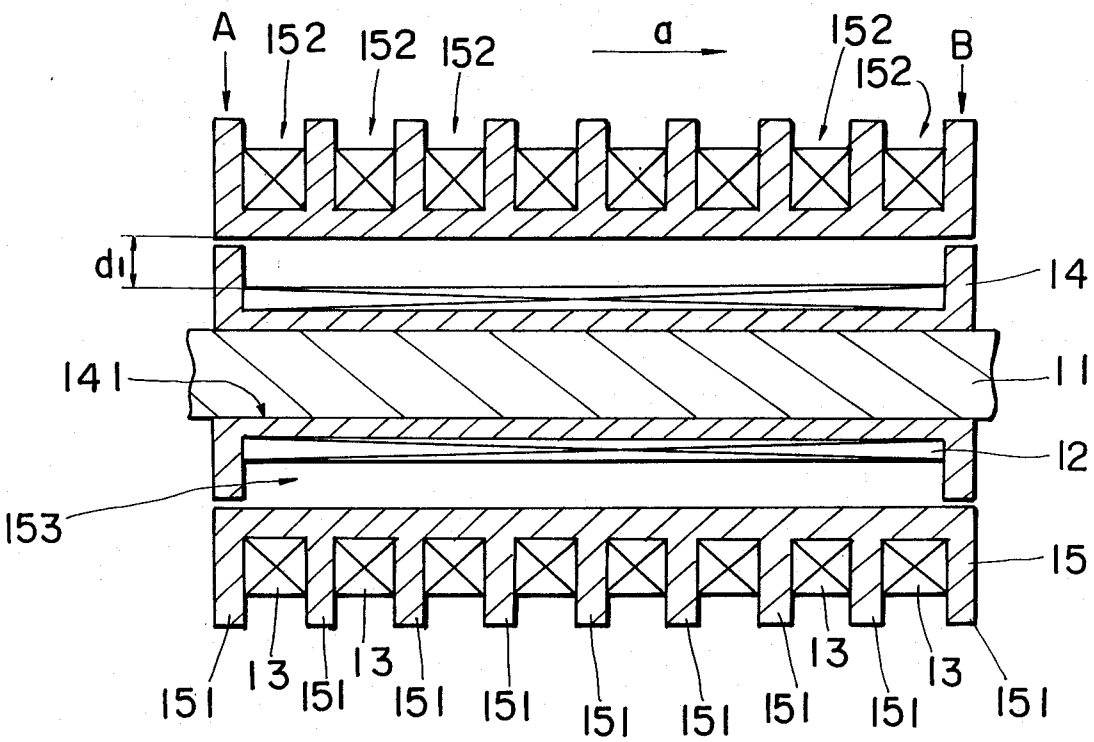
FIG. 10 PRIOR ART
FIG. 10 to 12 are sectional views of the essential part of some conventional coil devices in the prior art transformer.
Figure 11:
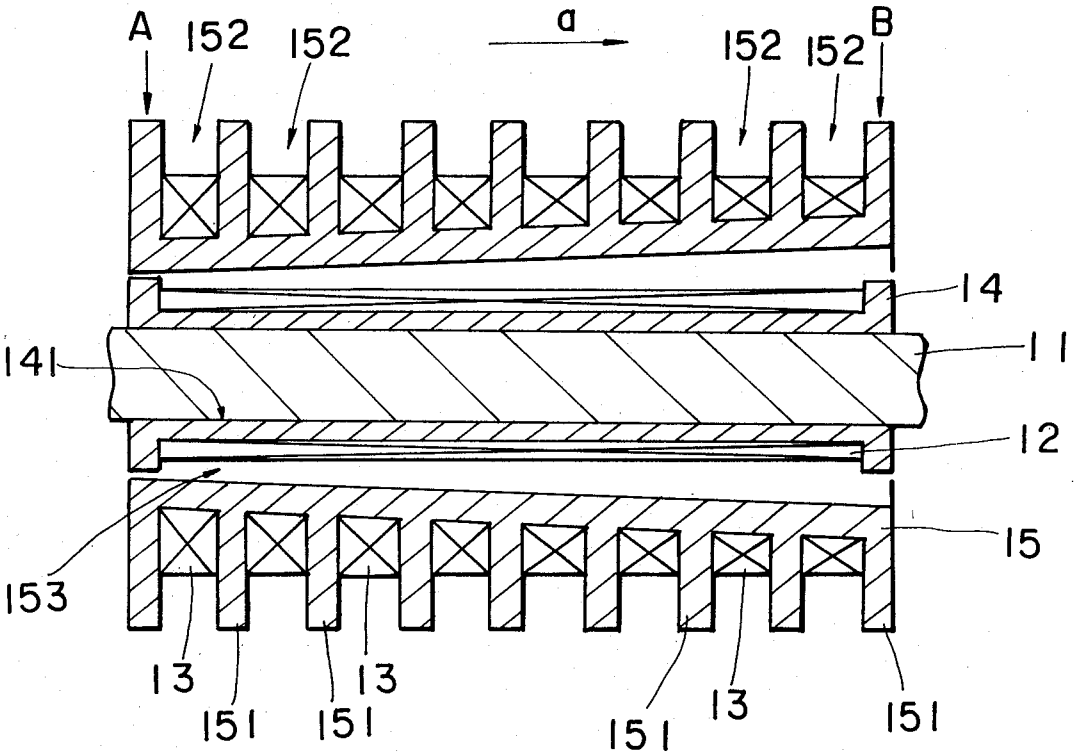
FIG. 11 PRIOR ART
Figure 12:
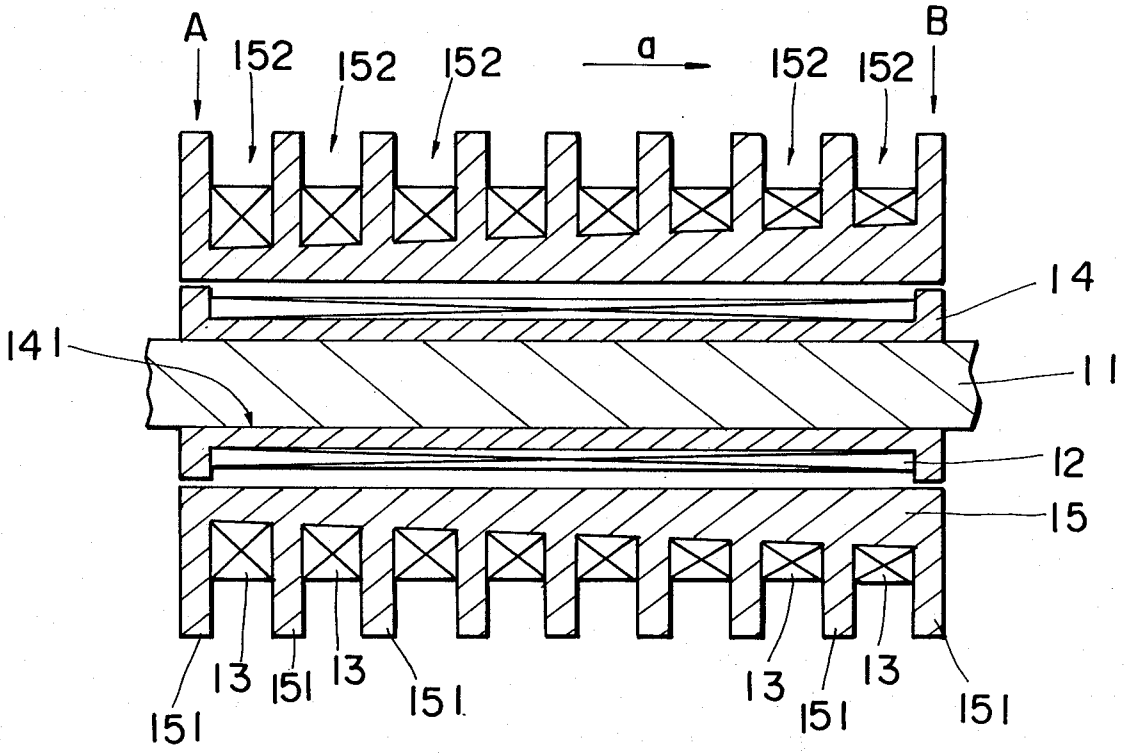
FIG. 12 PRIOR ART

FIGS. 6 and 7 show a third preferred embodiment of the present invention. Referring to FIG. 6 which is a sectional view of the essential part of the transformer, the core 1 is formed of ferrite, for example, and a portion 101 of the core 1 disposed concentrically of the coils 3 and 4 has a tapering cross section such that is gradually tapered from a low voltage side of the high-voltage output coil 4 to a high voltage side thereof. The low-voltage input coil 3 is disposed on the outer periphery of the core 1. The low-voltage input coil 3 is directly wound on the outer periphery of the core 1, or it is wound on a bobbin mounted on the core 1.

With this structure as mentioned above, an insulating distance between the low-voltage input coil 3 and the high-voltage output coil 4 is increased from the low voltage side to the high voltage side. The bobbin 7 is formed with a plurality of flange portions 71 defining a plurality of coil winding portions 52 where the high-voltage output coil 4 is wound. Each of the coil winding portions 52 has a straight bottom not tapered. Accordingly, the bobbin 7 is simplified in structure as compared with the prior art structure. Further, the insulating distance on the low voltage side between the low-voltage input coil 3 and the high-voltage output coil 4 is small, the magnetic connection may be improved, and the coil structure may be made compact.

FIG. 7 is a sectional view of the transformer shown in FIG. 6 to be applied to an ignition coil mounting an ignition plug therein. The portion 101 of the core 1 disposed concentrically of the coils 3 and 4 has a tapering cross section such that is gradually tapered from the low voltage side of the high-voltage output coil 4 to the high voltage side thereof. The portion 101 is inserted in the inner-diameter hole 61 of the bobbin 6 on which the low-voltage input coil 3 is wound. The core 1 is formed with a flange portion 102 at a lower end of the portion 101, so as to compensate a reduction in magnetic efficiency due to an open magnetic circuit and thereby improve the magnetic efficiency.

The connector 9 is mounted on the upper end surface 74 of the bobbin 7 on the opposite side of the flange portion 102 by suitable means such as adhesive or screw in such a manner that a mounting direction of the connector 9 coincides with the axial direction of the bobbin 7. The connector 9 is connected to one end of the high-voltage output coil 4. The insulating cover 5 is coaxially fitted with the bobbin 7 in such a manner as to surround the outer periphery of the bobbin 7. The insulating cover 5 has the upper opening 51 opposed to the connector 9 for permitting the ignition plug 10 to be inserted therethrough and be connected to the connector 9. Thus, the ignition plug 10 is directly connected to the connector 9 from the axial direction of the bobbin 7, and the mounting direction of the ignition plug 10 therefore substantially coincides with the axial direction of the coil device. With this arrangement, the connecting operation of the ignition plug may be made easy, and the general construction of the coil device mounting the ignition plug 10 may be made compact and simplified. Accordingly, an occupied area of the ignition coil may be reduced.

In this embodiment as is similar to the second preferred embodiment, the shield case 11 is fitted with the outer periphery of the insulating cover in such a manner as to surround the portion of the connector 9, so as to prevent the generation of electromagnetic wave noise from the connecting portion between the ignition plug 10 and the connector 9. The shield case 11 is formed of a magnetic conductive material such as iron and nickel, or a non-magnetic conductive material such as copper, and has a cylindrical shape having upper and lower end openings.

According to the third preferred embodiment as mentioned above, the rod portion of the core disposed concentrically of both the coils has a tapering cross section such that it is gradually tapered from the low voltage side of the high-voltage output coil to the high voltage side thereof, and the low-voltage input coil is disposed around the outer periphery of the rod portion of the core. With this arrangement, the insulating distance may be substantially enlarged to prevent dielectric breakdown between the low-voltage input coil and the high-voltage output coil without a reduction in magnetic connection between both the coils, and the general construction of the coil device may be made compact.

What is claimed is:

1. A transformer, comprising:
- a low-voltage input coil;
- a first bobbin around which said low-voltage input coil is wound, said first bobbin having an inner diameter hole;
- a high-voltage output coil;
- a second bobbin around which said high-voltage output coil is wound, said second bobbin having an inner-diameter hole;
- a core for magnetically connecting both of said coils together;
- a connector for connecting to an ignition plug;
- an insulating cover coaxially disposed of said second bobbin;
- a shield case for entirely surrounding said transformer,
- said core comprises a rod portion for insertion into said inner diameter hole of said first bobbin and a flange portion provided at one axial end of said core, said rod portion comprises a tapering cross-section such that said rod portion is gradually tapered from a low voltage side of said high-voltage output coil to a high-voltage side,
- said inner diameter hole of said first bobbin is formed to fit with said core,
- a coil winding section of said first bobbin is formed so as to define a sufficient insulating distance on said high voltage side,
- said connector is mounted on an end surface of said second bobbin on an opposite side of said flange portion of said core so that a mounting direction of said connector substantially coincides with an axial direction of said bobbin,
- said core is located in said inner diameter of said first bobbin, and
- said first bobbin is located in said inner diameter of said second bobbin.

2. The transformer as defined in claim 1, wherein said shield case is formed of a magnetic conductive material.

3. The transformer as defined in claim 1, wherein said low-voltage input coil is disposed around a surface of said core.

* * * * *